US006093135A

United States Patent [19]

Huang

[11] Patent Number: 6,093,135

[45] Date of Patent: Jul. 25, 2000

[54] MULTIPURPOSE EXERCISING MACHINE

[76] Inventor: Ming-Hui Huang, No 263, Tou-Yuan W Rd., Pei-Tou Hsiang, Chang-Hua Hsien, Taiwan

[21] Appl. No.: 09/181,219

[22] Filed: Oct. 29, 1998

[51] Int. Cl.[7] ..... A63B 69/06

[52] U.S. Cl. ..... 482/72; 482/112; 482/138; 482/140; 482/142

[58] Field of Search ..... 482/72, 73, 111, 482/112, 138, 140, 142

[56] References Cited

U.S. PATENT DOCUMENTS

| | | | |
|---|---|---|---|
| 5,580,340 | 12/1996 | Yu | 482/96 |
| 5,928,116 | 7/1999 | Chiang | 482/72 |
| 5,961,428 | 10/1999 | Webber | 482/100 |

*Primary Examiner*—Jerome W. Donnelly
*Assistant Examiner*—Tam Nguyen
*Attorney, Agent, or Firm*—Bacon & Thomas, PLLC

[57] ABSTRACT

A multipurpose exercising machine includes a machine base, a slide unit that can be slidably mounted on the machine base and fixed at a desired location, a height-adjustable leg bar unit pivoted to the machine base at one side for the positioning of the legs when the user exercises the motion of "sit-up", a bench unit having a fixed front end pivoted to the leg bar unit and a free rear end detachably supported on the slide unit at the machine base, a linking unit coupled between the machine base and the bench unit, two oars, two mounting assemblies which couple the oars to the middle portion of the machine base, and an elevation-adjustable foot support unit provided at the machine base at an opposite side for resting the user's legs when the user exercises the motion of "leg bending and pushing with back stretching" or the motion of "rowing".

6 Claims, 11 Drawing Sheets

MULTIPURPOSE EXERCISING MACHINE

BACKGROUND OF THE INVENTION

The present invention relates to exercising machines, and more particularly to a multipurpose exercising machine designed for exercising the motion of "sit-up", the motion of "leg bending and pushing with back stretching", as well as the motion of "rowing".

People living and working in cities may spend little time doing physical exercises. It is very beneficial to the health of a person to operate exercise machines to exercise the muscles of the body. A variety of exercising machines have been disclosed for different exercising purposes. However, few exercising machines are designed to stretch the back.

SUMMARY OF THE INVENTION

It is one object of the present invention to provide a multipurpose exercising machine which is practical for exercising the motion of "sit-up", the motion of "leg bending and pushing with back stretching", as well as the motion of "rowing". It is another object of the present invention to provide a multipurpose exercising machine which can be conveniently adjusted to fit individuals of different shapes and sizes. It is still another object of the present invention to provide a multipurpose exercising machine which has means to absorb shocks and buffer pressure. To achieve these and other objects of the present invention, there is provided a multipurpose exercising machine comprised of a machine base, a slide unit slidably mounted on the machine base and fixed at the desired location, a height-adjustable leg bar unit pivoted to the machine base at one side for the positioning of the legs when the user exercises the motion of "sit-up", a bench unit having a fixed front end pivoted to the leg bar unit and a free rear end detachably supported on the slide unit at the machine base, a linking unit coupled between the machine base and the bench unit, two oars, two mounting assemblies which couple the oars to the middle section of the base, and an elevation-adjustable foot support unit provided at the machine base for the resting of the user's legs when the user exercises the motion of "leg bending and pushing with back stretching" or the motion of "rowing".

DETAILED DESCRIPTION OF THE PREFERRED EMBODIMENT

Figure 1:
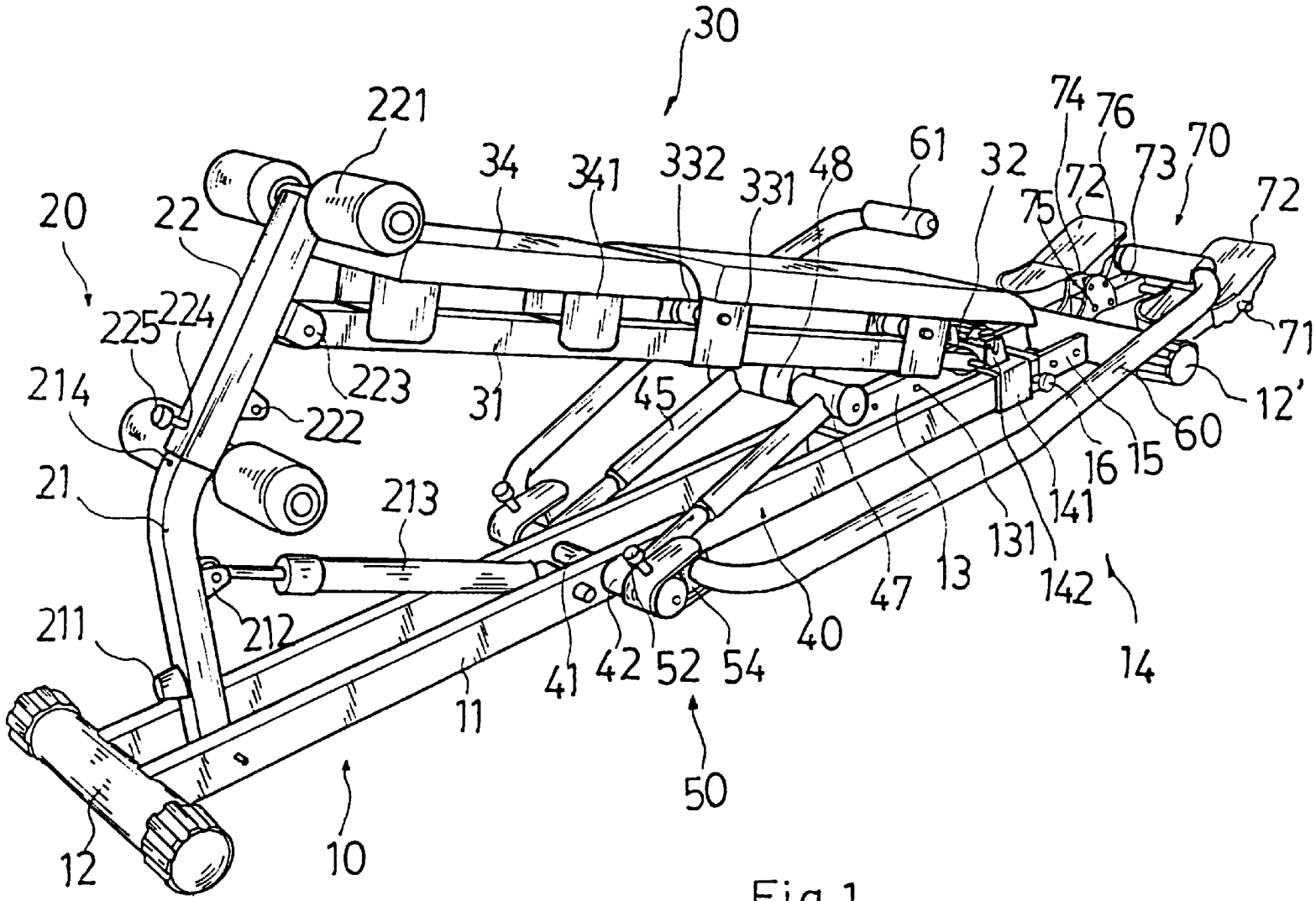
FIG. 1 is a perspective view of a multipurpose exercising machine according to the present invention.

Referring to Figures from 1 through 6, a multipurpose exercising machine in accordance with the present invention is generally comprised of a machine base 10, a leg bar unit 20 pivoted to the machine base 10 at one side namely the front side, a bench unit 30 pivoted to the leg bar unit 20 at the top side, a linking unit 40, two mounting assemblies 50 and two oars 60 coupled to the machine base 10 on the middle, and a foot support unit 70 provided at the machine base 10 at one side namely the rear side.

Figure 4:
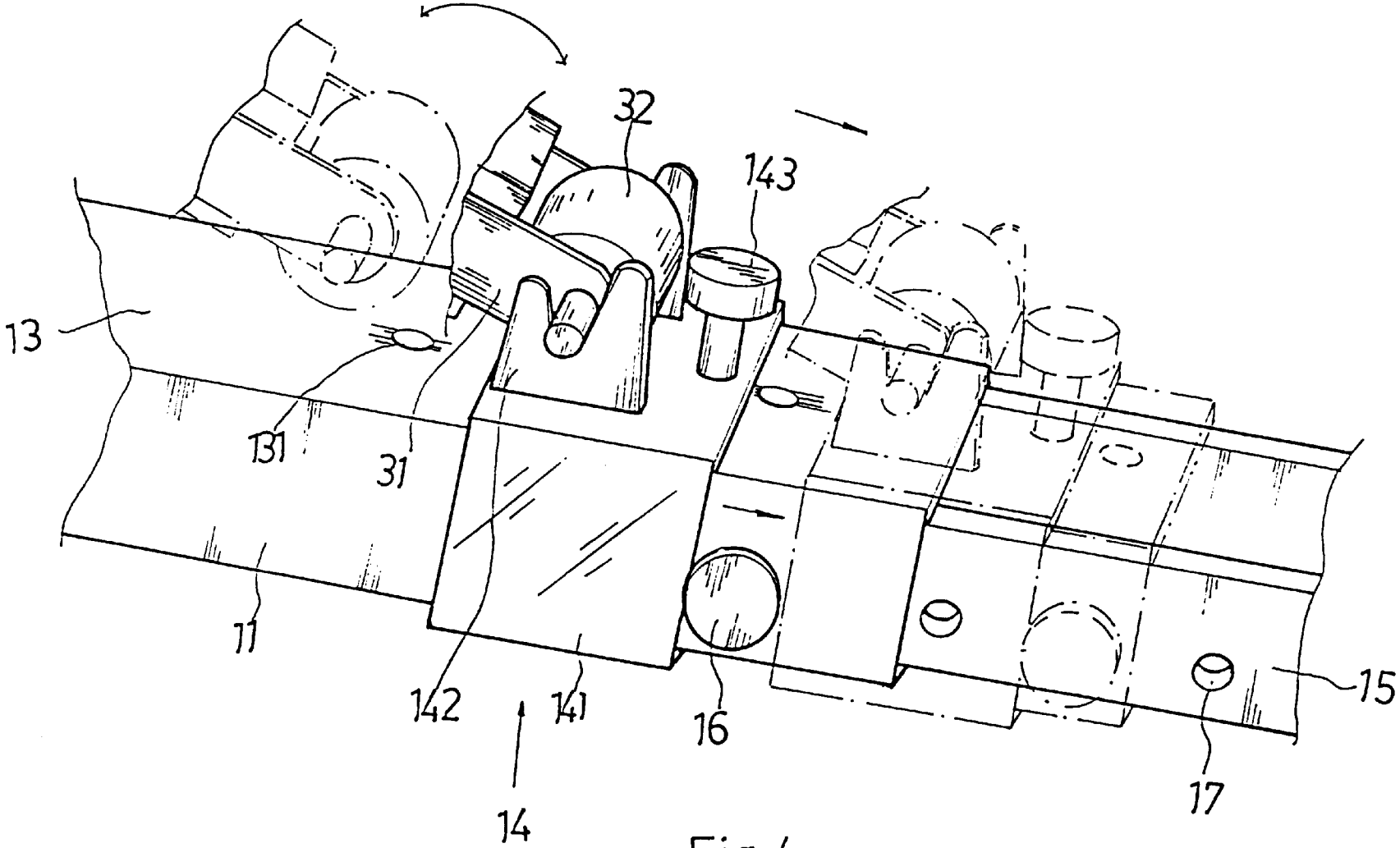
FIG. 4 is a schematic drawing showing the adjustment of extension bars and slide unit of the machine base according to the present invention.

Referring to FIGS. 1 and 4 again, the machine base 10 comprises a front transverse locating bar 12 and a rear transverse locating bar 12' arranged in parallel at front and rear sides, two tubular rails 11 connected in parallel between the transverse locating bars 12,12', the tubular rails 11 each having a front end welded to the front transverse locating bar 12 and a rear end spaced from the rear transverse locating bar 12', two extension bars 15 respectively moved in and out of the rear ends of the tubular rails 11 and perpendicularly welded to the rear transverse locating bars 12', the extension bars 15 each having a longitudinal series of locating holes 17, two lock pins 16 respectively mounted in a respective pin hole (not shown) at the tubular rails 11 and selectively inserted through the locating holes 17 at the extension bars 15, a locating frame 13 fixedly connected between the tubular rails 11 near the rear side, the locating frame 13 having a longitudinal series of locating holes 131, and a slide unit 14 mounted on the locating frame 13. The slide unit 14 comprises a slide 141 longitudinally and slidably mounted on the locating frame 13, upright support means 142 raised from the slide 141, and a lock pin 143 mounted in a pin hole (not shown) on the slide 141 and inserted into one locating hole 131 at the locating frame 13 to fix the slide 141 to the locating frame 13 at the desired location.

Figure 2:
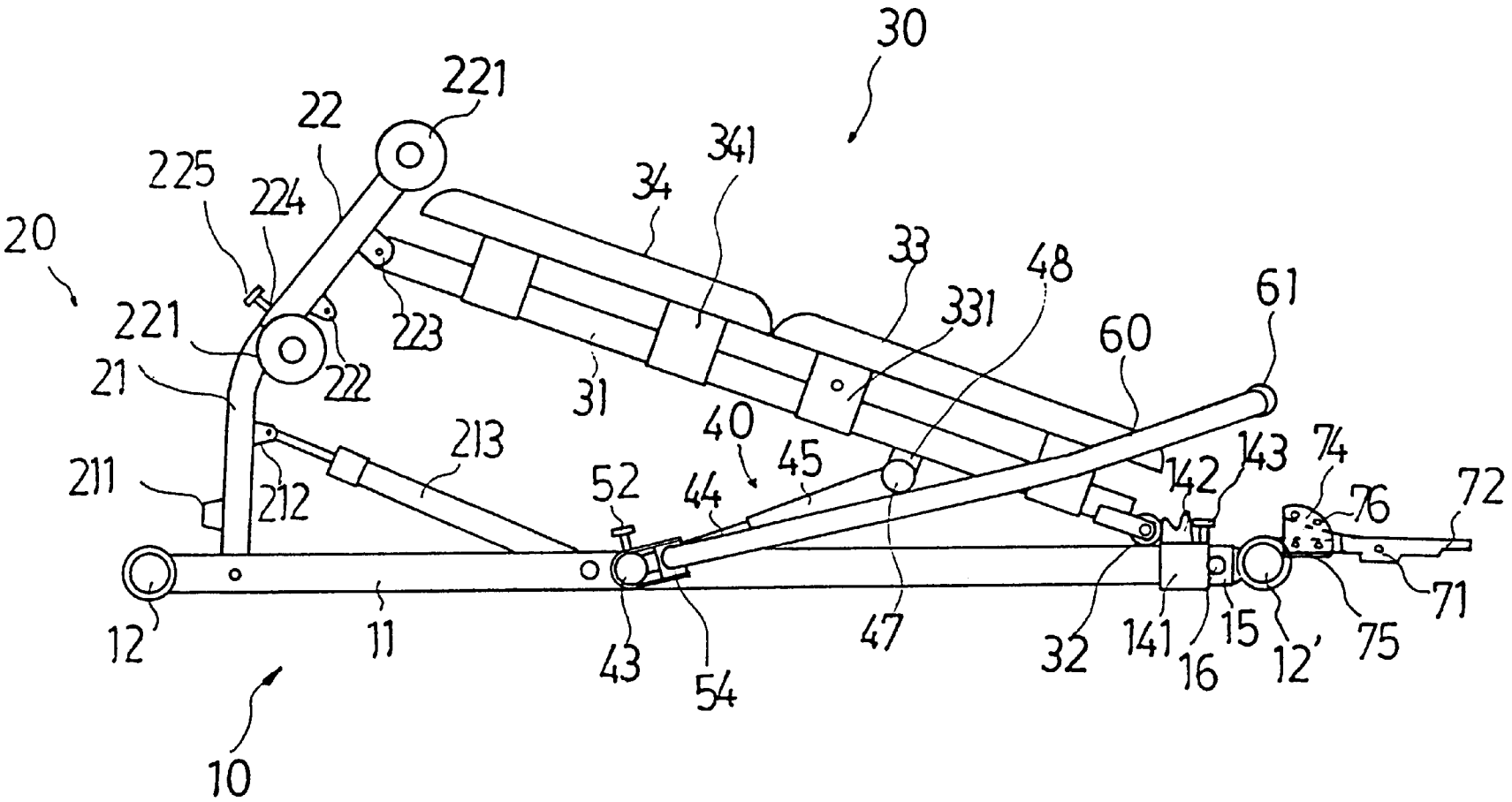
FIG. 2 is a side view of the multipurpose exercising machine shown in FIG. 1.
Figure 8:
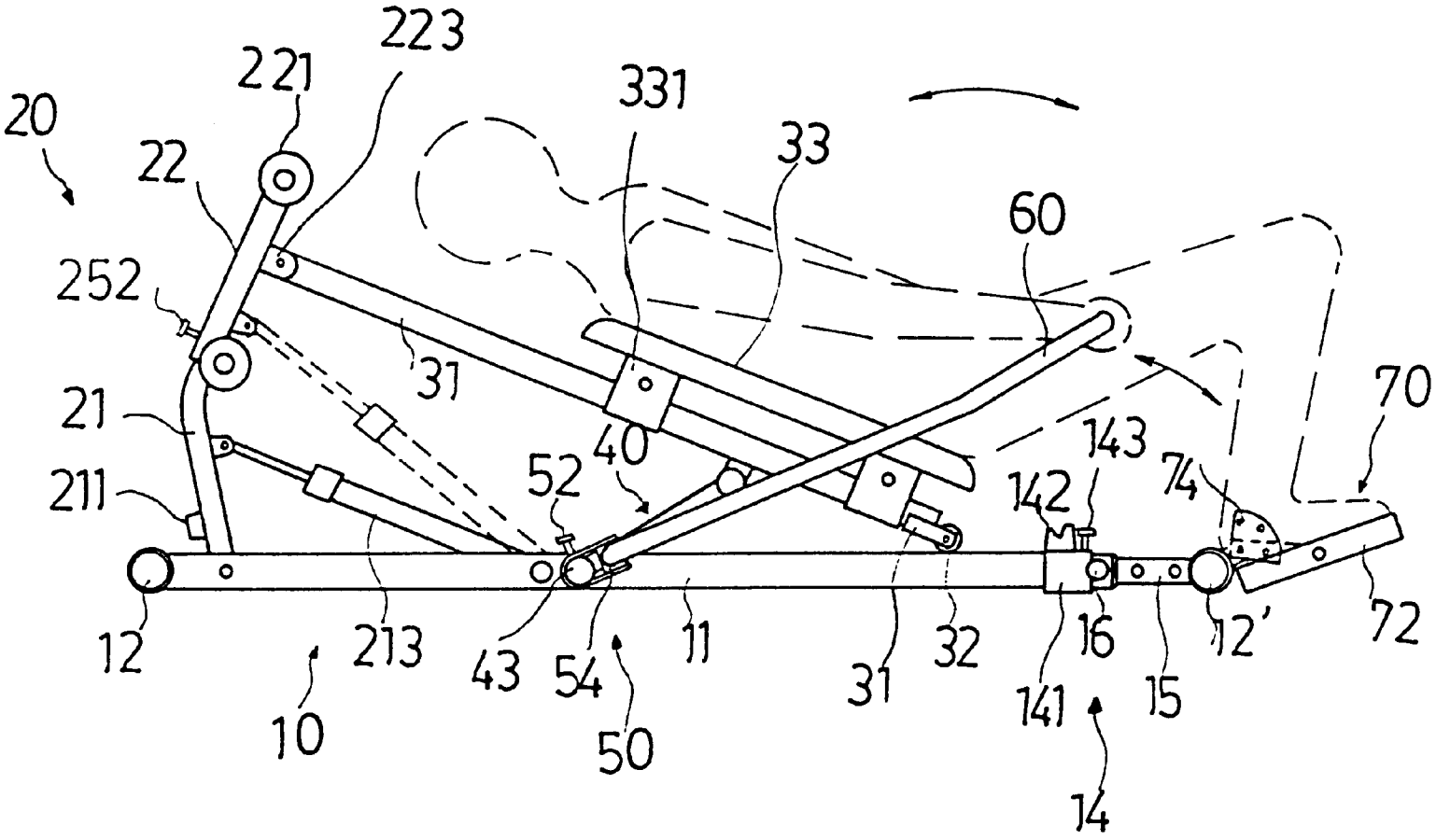
FIG. 8 illustrates another application example of the present invention, showing the exercise of "leg bending and pushing with back stretching" (Step I).
Figure 9:
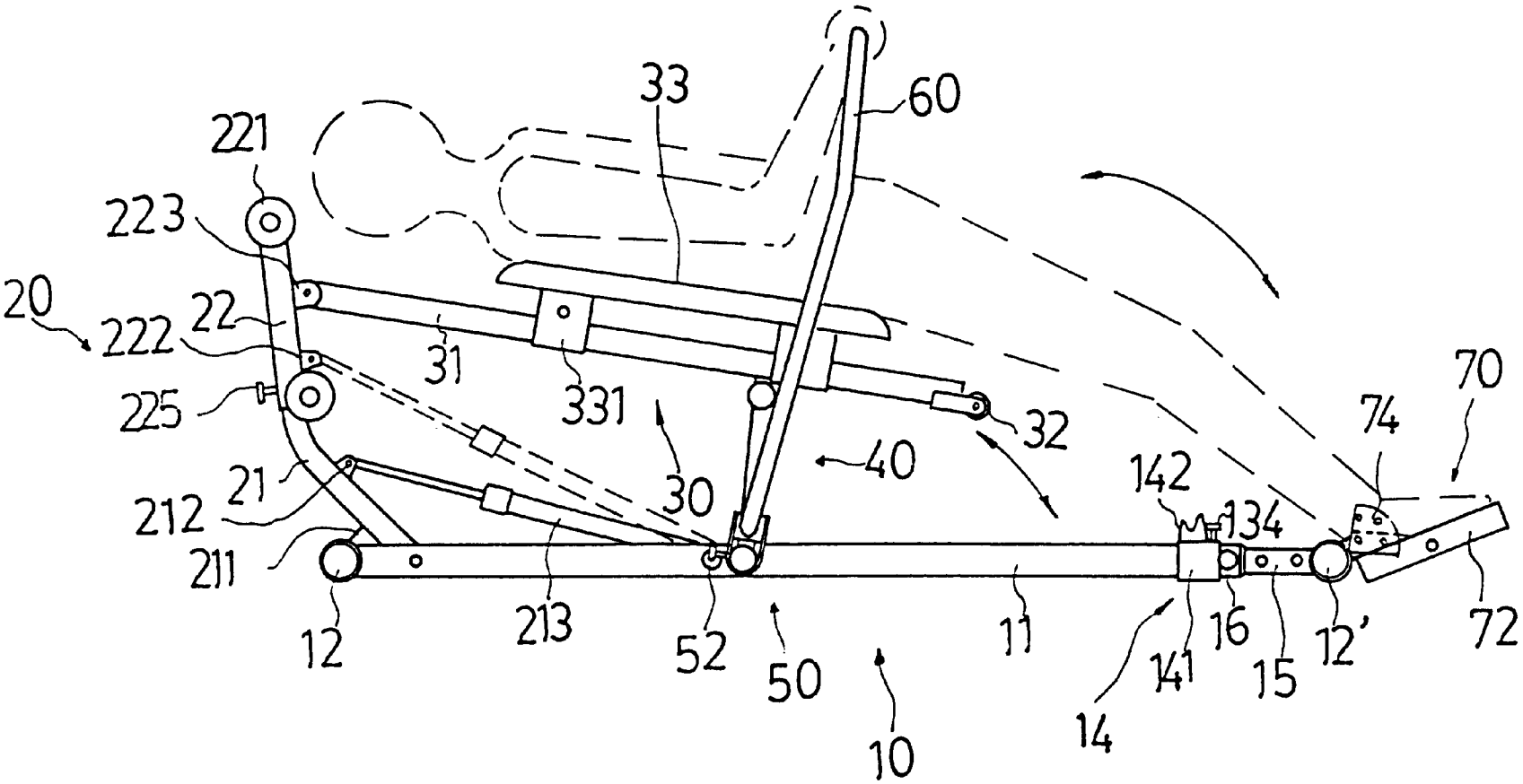
FIG. 9 illustrates another application example of the present invention, showing the exercise of "leg bending and pushing with back stretching" (Step II).

Referring to FIGS. 1 and 2 again, the leg bar unit 20 comprises a curved mounting bar 21 pivotably connected between the tubular rails 11 near the front transverse locating bar 12 by pivot means, the curved mounting bar 21 having a longitudinal series of locating holes 214, a sleeve 22 sleeved onto the curved mounting bar 21 at the top, the sleeve 22 having a pin hole 224 near its bottom end selectively connected to the locating holes 214 at the curved mounting bar 21 by a lock pin 225, a stop block 211 raised from the curved mounting bar 21 at its front side for supporting the curved mounting bar 21 at the front transverse locating bar 12 when the curved mounting bar 21 is turned downwardly forwards (see FIG. 11), two pairs of transverse leg bars 221 provided at the sleeve 22 at different elevations for the positioning of the legs, a first locating frame 212 provided at the curved mounting bar 21 at its rear side, a second locating frame 222 provided at the sleeve 22, a third locating frame 223 provided at the sleeve 22 above the second locating frame 222, and a hydraulic resistance 213 having one end pivoted to the tubular rails 11 and an opposite end selectively connected to the first locating frame 212 or the second locating frame 222 (see also FIGS. 8 and 9).

Figure 3:
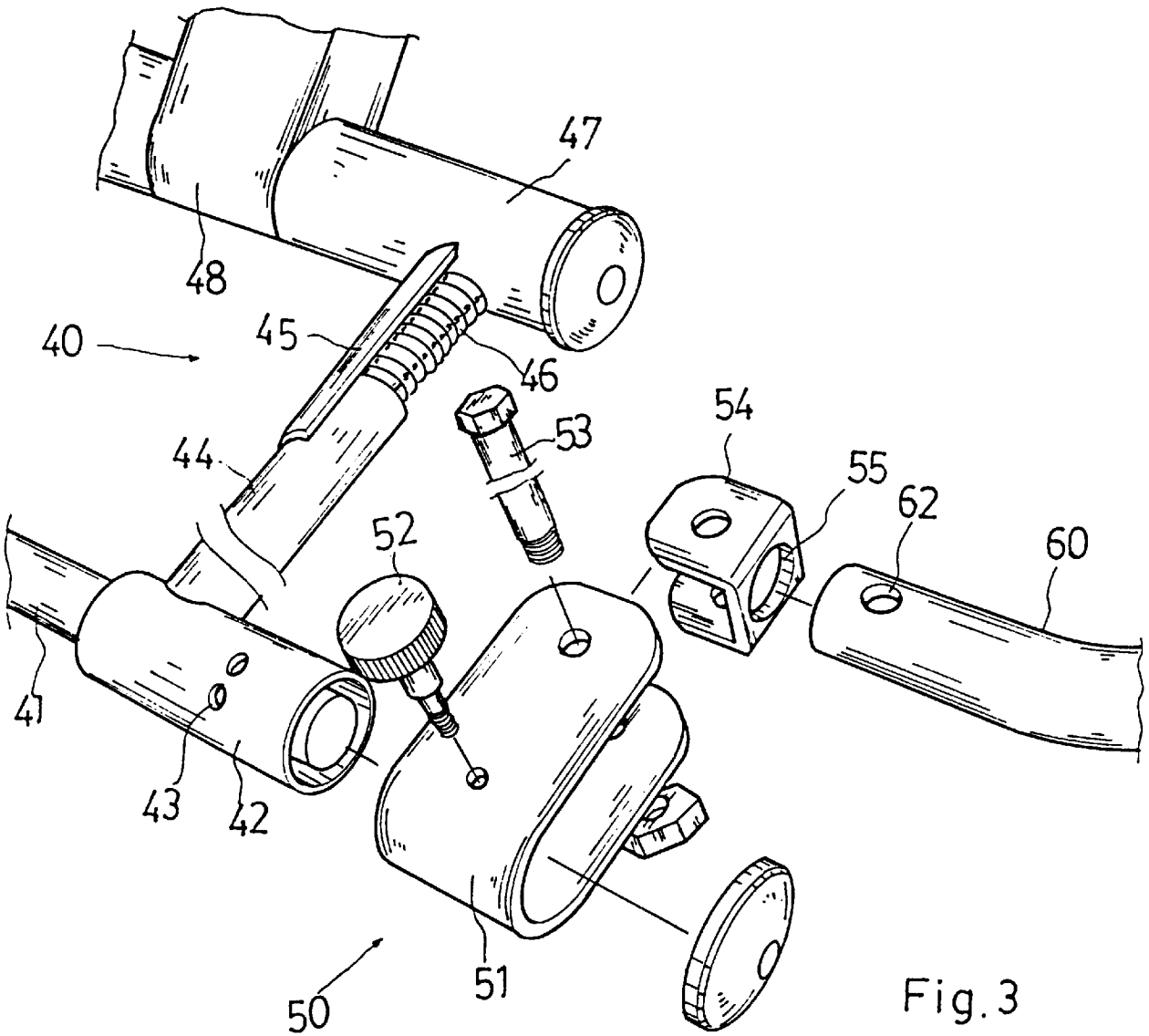
FIG. 3 is an exploded view of a part of the present invention, showing the arrangement of the linking unit and the mounting assembly.

Referring to FIGS. 1, 2 and 3 again, the bench unit 30 comprises a bottom frame 31 having a front end pivoted to the third locating frame 223 at the sleeve 22 of the leg bar unit 20 and a rear end pivotably supported on the upright support means 142 of the slide unit 14, a roller 32 mounted on the rear end of the bottom frame 31 and peripherally disposed in contact with the slide 141, a detachable seat 34 detachably mounted on the bottom frame 31, the detachable seat 34 having two substantially H-shaped foot frames 341 for positioning on the bottom frame 31, and a sliding seat 33 slidably mounted on the bottom frame 31. The sliding seat 33 comprises two pairs of substantially L-shaped foot frames 331 respectively hooked on the bottom side wall of the bottom frame 31, and two transverse rollers 332 respectively connected between the L-shaped foot frames 331 and retained in contact with the top side wall of the base frame 31.

Referring to FIGS. 1, 2 and 3 again, the linking unit 40 comprises a transverse shaft 41 connected between the tubular rails 11 of the machine base 10, two first barrels 42 respectively coupled to two opposite ends of the transverse shaft 41 at two opposite sides of the tubular rails 11, the first barrels 42 each having a plurality of radially spaced locating holes 43 for holding the oars 60 at any of a variety of angles, two fixed bars 44 respectively and perpendicularly raised from the periphery of the first barrels 42, a locating frame 48 fixedly connected to the bottom frame 31 of the bench unit 30 at the bottom side, two second barrels 47 bilaterally pivoted to the locating frame 48, two sleeves 45 respectively raised from the periphery of the second barrels 47 and sleeved onto the fixed bars 44, and two compression springs 46 respectively mounted in the sleeves 45 and stopped between the periphery of the second barrels 47 and the free ends of the fixed bars 44.

Referring to FIGS. 1, 2 and 3 again, the mounting assemblies 50 are respectively coupled between the first barrels 42 of the linking unit 40 and the oars 60. Each mounting assembly 50 comprises a substantially U-shaped mounting frame 51 coupled to one first barrel 42, a lock pin 52 fastened to one locating hole 43 at the corresponding first barrel 42 to fix the U-shaped mounting frame 51 to the corresponding first barrel 42 at the desired angle, a connector 54 having a receiving hole 55, which receives one end of the corresponding oar 60, and a screw bolt 53 fastened to the U-shaped mounting frame 51 to secure the connector 54 and one oar 60 in place.

Referring to FIGS. 1, 2 and 3 again, the oars 60 each have a mounting hole 62 at one end coupled to the screw bolt 53 at the U-shaped mounting frame 51 of one mounting assembly 50, and a hand grip 61 at an opposite end.

Figure 5:
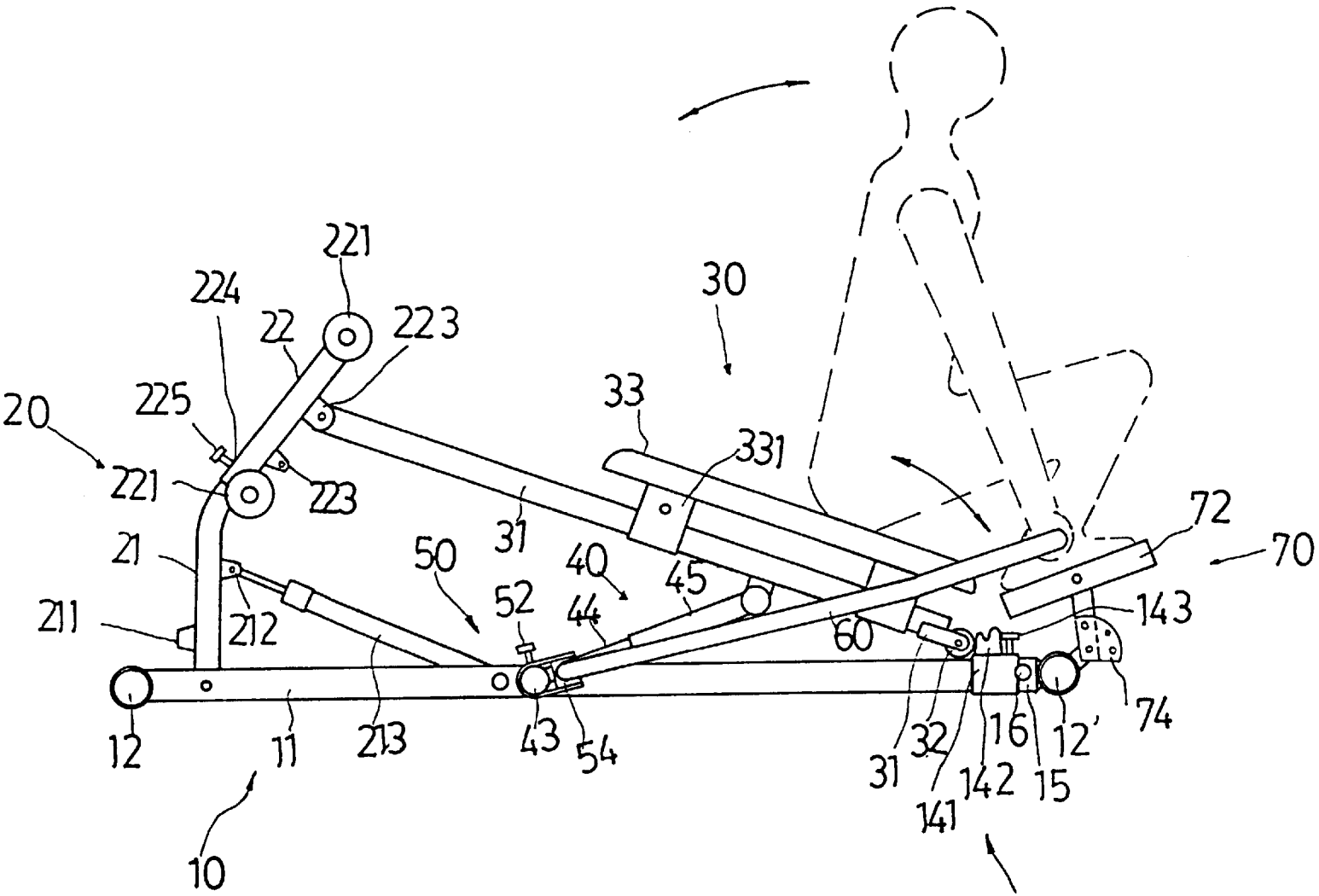
FIG. 5 shows the multipurpose exercising machine adjusted to one operation position according to the present invention.
Figure 6:
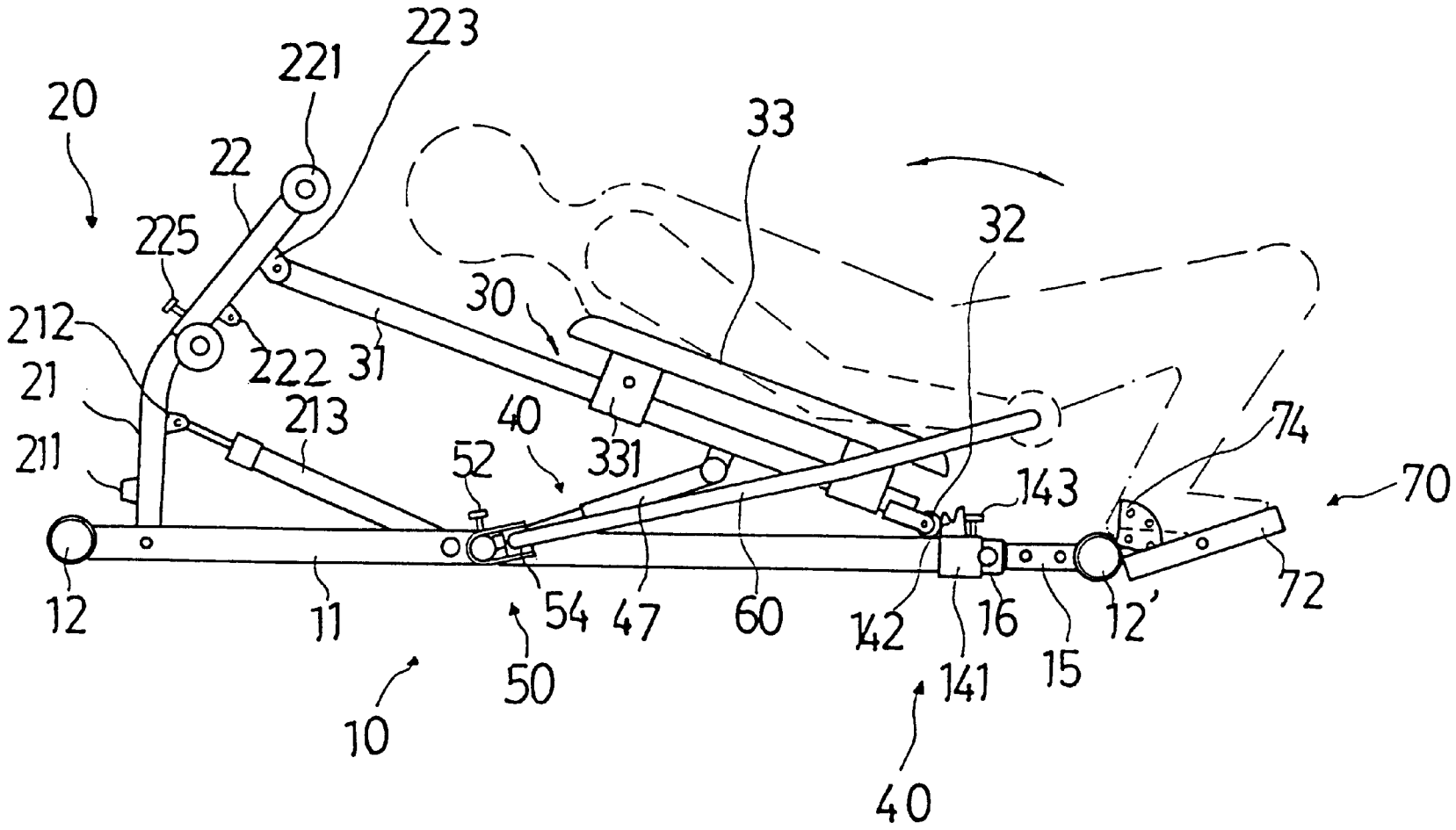
FIG. 6 shows the multipurpose exercising machine adjusted to another operation position according to the present invention.

Referring to FIGS. 1 and 2 again, the foot support unit 70 comprises a holder frame 74 fixedly mounted on the rear transverse locating bar 12', the holder frame 74 having a pivot hole 75 and three locating holes 76 equally spaced from the pivot hole 75 at different angles, a locating bar 73 having one end pivoted to the pivot hole 75 and an opposite end mounted with a transverse axle 71, and two foot plates 72 respectively pivoted to two opposite ends of the transverse axle 71. The locating bar 73 can be attach to selectively fixed to one of the locating holes 76 by a lock pin, enabling the user to exercise the motion of rowing (see FIG. 5) and the motion of leg bending and pushing with back stretching (see FIG. 6).

Figure 7:
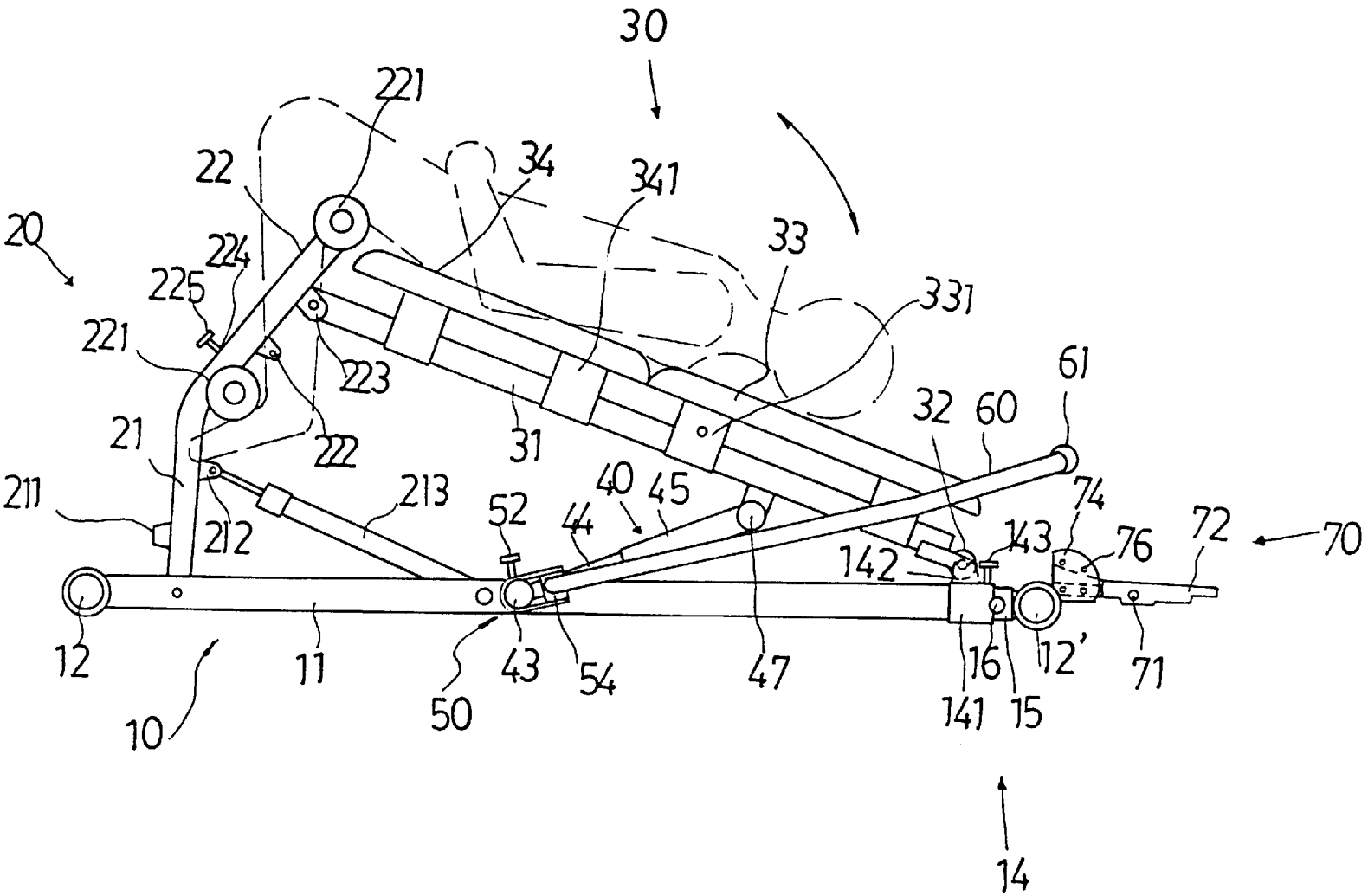
FIG. 7 illustrates an application example of the present invention, showing the exercise of "sit-up".

FIG. 7 illustrates an application of the present invention in exercising the motion of "sit-up". When the roller 32 of the bench unit 30 is supported on the upright support means 142 of the slide unit 14, the user can lie on the bench unit 30 with the legs hung on the transverse leg bars 221, and then exercise the motion of "sit-up". By means of adjusting the elevational position of the sleeve 22 on the curved mounting bar 21 and the position of the slide 141 on the machine base 10, the tilting angle of the bench unit 30 is relatively adjusted to fit individual's requirements.

FIGS. 8 and 9 illustrate another application of the present invention in exercising the motion of leg bending and pushing with back stretching. Before exercising this motion, the detachable seat 34 is removed from the bottom frame 31, the roller 32 is moved with the bottom frame 31 away from the upright support means 142, and the foot plates 72 of the foot support unit 70 are adjusted to the lowest position. When in operation, the user lies on the back on the sliding seat 33, the hand grips 61 of the oars 60 are firmly seized with the hands, and user's legs are rested on the foot plates 72, and then the user row the oars 60 and alternatively bend and push the legs, causing the back to be alternatively stretched and released. When the bench unit 30 is pushed forwards as the user's back is stretched as shown in FIG. 9, the stop block 211 is moved with the curved mounting bar 21 toward the front transverse locating bar 12 to limit the forward stroke of the leg bar unit 20. Further, during exercising, the compression springs 46 of the linking unit 40 are compressed and released to buffer the pressure. When the oars 60 are pushed downwards, the linking unit 40 is turned downwards to lower the bench unit 30 (see FIG. 8).

Figure 10:
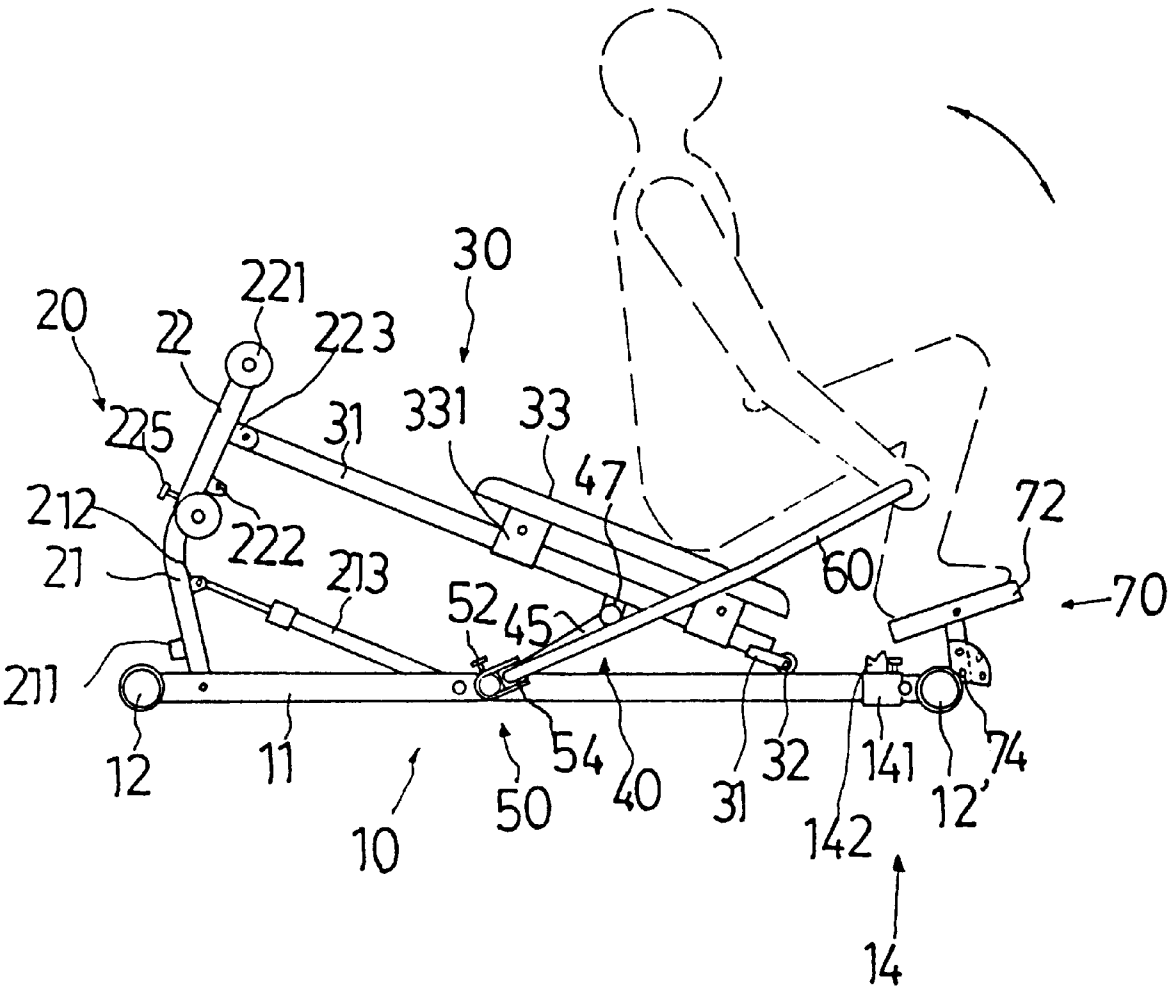
FIG. 10 illustrates still another application example of the present invention, showing the exercise of "rowing" (Step I).
Figure 11:
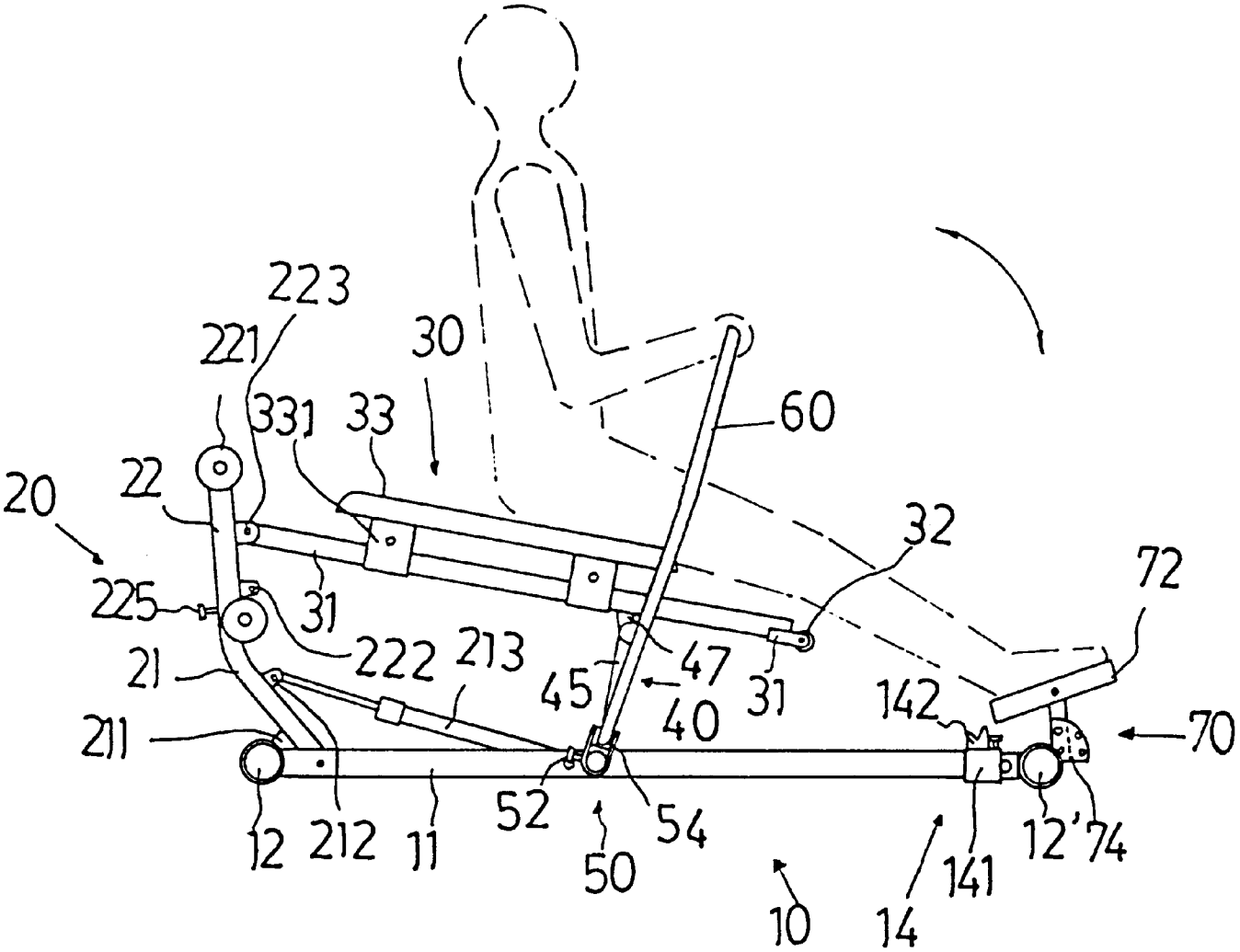
FIG. 11 illustrates still another application example of the present invention, showing the exercise of "rowing" (Step II).

FIGS. 10 and 11 illustrate still another application of the present invention in exercising the motion of rowing. Before exercising the motion of rowing, the detachable seat 34 is removed from the bottom frame 31, the roller 32 is moved with the bottom frame 31 away from the upright support means 142, and the foot plates 72 of the foot support unit 70 are adjusted to a higher position. When in use, the user sits on the sliding seat 33 with the legs rested on the foot plates 72 and the hands holding on the hand grips 61 of the oars 60, then the oars 60 are pulled upwards and the legs are extended out, causing the bench unit 30 to be lifted from the tubular rails 11 of the machine base 10 (see FIG. 11). When the bench unit 30 is moved to the upper limit position (the position shown in FIG. 11), the stop block 211 is stopped at the front transverse locating bar 12. After the bench unit 30 has been moved to the upper limit position, the oars 60 are turned downwards to lower the bench unit 30 from the position shown in FIG. 11 to its former position shown in FIG. 10. During exercising, the compression springs 46 of the linking unit 40 are compressed and released to buffer the pressure. Further, the hydraulic resistance 213 can be alternatively pivoted to the first locating frame 212 or the second locating frame 222 to change the damping resistance.

What is claimed is:

1. A multipurpose exercising machine comprising:

a machine base, said machine base comprising a front transverse locating bar and a rear transverse locating bar arranged in parallel, two rails connected in parallel between said front and rear transverse locating bars, a locating frame fixedly connected between said rails, said locating frame having a longitudinal series of locating holes, and a slide unit mounted on said locating frame, said slide unit comprising a slide longitudinally slidably mounted on said locating frame, upright support means raised from said slide, and a lock pin mounted in a pin hole on said slide and inserted into one locating hole at said locating frame to fix said slide to said locating frame;

a leg bar unit pivoted to said machine base near one side, said leg bar unit comprising a curved mounting bar pivoted to the rails of said machine base near said front transverse locating bar, a sleeve mounted on said curved mounting bar, two pairs of transverse leg bars provided at said sleeve at different elevations for the positioning of the user's legs, and a hydraulic resistance having a fixed end pivoted to the rails of said machine base and a movable end pivoted to said curved mounting bar;

a bench unit coupled between said machine base and said leg bar unit, said bench unit comprising a bottom frame having a front end pivoted to the sleeve of said leg bar unit and a rear end mounted with a roller for supporting on the upright support means of the slide unit of said machine base, a detachable seat detachably mounted on said bottom frame, said detachable seat having foot frames for positioning on said bottom frame, and a sliding seat moved on said bottom frame;

a linking unit coupled between said machine base and said bench unit, said linking unit comprising a transverse shaft connected between the rails of said machine base, two first barrels respectively coupled to two opposite ends of said transverse shaft at two opposite sides of the rails of said machine base, said first barrels each having a plurality of radially spaced locating holes, two fixed bars respectively perpendicularly raised from the periphery of said first barrels, a locating frame fixedly connected to the bottom frame of said bench unit, two second barrels bilaterally pivoted to said locating frame of said linking unit, two sleeves respectively raised from the periphery of said second barrels and sleeved onto said fixed bars, and two spring elements respectively mounted in the sleeves of said linking unit and stopped between the periphery of said second barrels and said fixed bars;

two oars respectively coupled to said linking unit, said oars each having a mounting hole at one end and a hand grip at an opposite end;

two mounting assemblies respectively coupled between the first barrels of said linking unit and said oars, said mounting assemblies each comprising a substantially U-shaped mounting frame coupled to one first barrel of said linking unit, a lock pin selectively fastened to the locating holes at one first barrels of said linking unit to fix said U-shaped mounting frame to the corresponding first barrel at the desired angle, a connector having a receiving hole, which receives one oar, and a screw bolt fastened to said U-shaped mounting frame and the locating hole at one end of the corresponding oar to secure said connector and the corresponding oar together, permitting the corresponding oar to be turned about said screw bolt; and a foot support unit coupled to the rear transverse locating bar of said machine base, said foot support unit comprising a holder frame fixedly mounted on said rear transverse locating bar of said machine base, a locating bar having one end pivoted to said holder frame and an opposite end mounted with a transverse axle, and two foot plates respectively pivoted to two opposite ends of said transverse axle.

2. The multipurpose exercising machine of claim 1 wherein the rails of said machine base each have a front end fixedly connected to said front transverse locating bar and a rear end coupled with a respective extension bar, said extension bar having one end fixedly connected to said rear transverse locating bar, and a front end made with a longitudinal series of locating holes selectively fastened to the corresponding rail by a lock pin.

3. The multipurpose exercising machine of claim 1 wherein the curved mounting bar of said leg bar unit comprises a longitudinal series of locating holes disposed at different elevations, and the sleeve of said leg bar unit has a pin hole near a bottom end thereof selectively connected to the locating holes at said curved mounting bar by a lock pin.

4. The multipurpose exercising machine of claim 1 wherein said leg bar unit comprises a stop block raised from a front side of said curved mounting bar for supporting said curved mounting bar at said front transverse locating bar when said curved mounting bar is turned downwardly forwards, and two locating frames respectively provided at said curved mounting bar at different elevations for selectively holding the movable end of said hydraulic resistance.

5. The multipurpose exercising machine of claim 1 wherein said holder frame of said foot support unit has a plurality of locating holes disposed at different angles, and said locating bar is selectively fixed to the locating holes at said holder frame by a lock pin.

6. The multipurpose exercising machine of claim 1 wherein said sliding seat of said bench unit comprises two pairs of substantially L-shaped foot frames respectively hooked on a bottom side wall of the bottom frame of said bench unit, and two transverse rollers respectively connected between said L-shaped foot frames and retained in contact with a top side wall of said base frame.

* * * * *